US007921653B2

(12) United States Patent
Som et al.

(10) Patent No.: US 7,921,653 B2
(45) Date of Patent: Apr. 12, 2011

(54) INTERNAL MANIFOLD AIR EXTRACTION SYSTEM FOR IGCC COMBUSTOR AND METHOD

(75) Inventors: Abhijit Som, Greer, SC (US); Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 806 days.

(21) Appl. No.: 11/984,925

(22) Filed: Nov. 26, 2007

(65) Prior Publication Data

US 2009/0133403 A1 May 28, 2009

(51) Int. Cl.
*F02C 6/06* (2006.01)
*F23R 3/26* (2006.01)
*F23R 3/46* (2006.01)

(52) U.S. Cl. ..... 60/782; 60/785; 60/752

(58) Field of Classification Search ..... 60/782, 60/785, 752, 760

See application file for complete search history.

(56) References Cited

U.S. PATENT DOCUMENTS 3,879,940 A * 4/1975 Stenger et al. ..... 60/737
4,255,927 A * 3/1981 Johnson et al. ..... 60/39.37
4,329,114 A * 5/1982 Johnston et al. ..... 60/785
4,903,477 A * 2/1990 Butt ..... 60/39.37
4,928,479 A * 5/1990 Shekleton et al. ..... 60/760
5,161,367 A * 11/1992 Scalzo ..... 60/39.37
6,449,956 B1 * 9/2002 Kolman et al. ..... 60/760
6,672,072 B1 * 1/2004 Giffin, III ..... 60/782
6,948,318 B2 9/2005 Peyron
2005/0166599 A1 * 8/2005 Terazaki et al. ..... 60/785

OTHER PUBLICATIONS

U.S. Application of Johnson et al.; U.S. Appl. No. 11/905,238, filed Nov. 28, 2007.

* cited by examiner

*Primary Examiner* — Ted Kim
(74) *Attorney, Agent, or Firm* — Nixon & Vanderhye PC

(57) ABSTRACT

A combustor for a turbine including a combustor liner; a first flow sleeve surrounding the combustor liner with a first flow annulus therebetween, the first flow sleeve having at least one cooling aperture formed about a circumference thereof for directing compressor discharge air as cooling air into the first flow annulus; a casing surrounding first flow sleeve with a second flow annulus therebetween, the first flow sleeve having at least one air extraction opening formed about a circumference thereof for directing compressor discharge air from the first flow annulus as extraction air into the second flow annulus; and an extraction port operatively coupled to the casing for extracting the extraction air from the second flow annulus.

21 Claims, 6 Drawing Sheets

INTERNAL MANIFOLD AIR EXTRACTION SYSTEM FOR IGCC COMBUSTOR AND METHOD

BACKGROUND OF THE INVENTION

A gas turbine is conventionally comprised of a compressor, a combustor, and a turbine. The turbine is coupled to the compressor in order to drive the compressor. The combustion chamber receives fuels such as a combustion gas, and a certain amount of nitrogen, to lower the flame temperature in the combustion chamber of the combustor, which makes it possible to minimize the discharge of nitrogen oxides to atmosphere. The combustion gas may be obtained by gasification, that is, oxidation of carbon products such as coal. This partial oxidation is carried in an independent unit referred to as a gasifier. Conventionally, the gas turbine is combined with an air separation unit. The air separation unit enables at least one gas stream, mostly consisting of one of the gases of air, especially oxygen or nitrogen, to be supplied from input air. To combine the air separation unit with the gas turbine, the oxygen and nitrogen produced in the air separation unit are admitted respectively into the gasifier and the combustion chamber of the combustor.

SUMMARY OF THE INVENTION

The present invention proposes the combination of a gas turbine and air separation unit, wherein the inlet air delivered to the air separation unit is supplied, at least in part, by the gas turbine.

Thus, the invention may be embodied in a combustor for a turbine comprising: a combustor liner; a first flow sleeve surrounding said combustor liner with a first flow annulus therebetween, said first flow sleeve having at least one cooling aperture formed about a circumference thereof for directing compressor discharge air as cooling air into said first flow annulus; a casing surrounding first flow sleeve with a second flow annulus therebetween, said first flow sleeve having at least one air extraction opening formed about a circumference thereof for directing compressor discharge air from said first flow annulus as extraction air into said second flow annulus; and an extraction port operatively coupled to said casing for extracting said extraction air from said second flow annulus.

The invention may also be embodied in a turbine engine comprising: combustion section; an air discharge section downstream of the combustion section; a transition region between the combustion and air discharge sections; a combustor liner defining a portion of the combustion section and transition region; a first flow sleeve surrounding said combustor liner with a first flow annulus therebetween, said first flow sleeve having at least one cooling aperture formed about a circumference thereof for directing compressor discharge air as cooling air into said first flow annulus; a casing surrounding first flow sleeve with a second flow annulus therebetween, said first flow sleeve having at least one air extraction opening formed about a circumference thereof for directing compressor discharge air from said first flow annulus as extraction air into said second flow annulus; and an extraction port operatively coupled to said casing for extracting said extraction air from said second flow annulus.

The invention may also be embodied in a method of extracting air from a combustion section comprising a combustor liner, a first flow sleeve surrounding said combustor liner with a first flow annulus therebetween, and a casing surrounding said first flow sleeve, said first flow sleeve having at least one cooling aperture formed about a circumference thereof for directing compressor discharge air as cooling air into said first flow annulus, the method comprising: forming a second flow annulus between said casing and said first flow sleeve; forming at least one air extraction opening about a circumference thereof for directing compressor discharge air from said first flow annulus as extraction air into said second flow annulus; operatively coupling an extraction port to said casing for extracting said extraction air from said second flow annulus; supplying compressor discharge air through said at least one cooling aperture into said first flow annulus; flowing extraction air from said first flow annulus through said at least one air extraction opening into said second flow annulus; and extracting air from said second flow annulus through said extraction port.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Traditional gas turbine combustors use diffusion (i.e., non-premixed) combustion in which fuel and air enter the combustion chamber separately. The process of mixing and burning produces flame temperatures exceeding 3900° F. Since conventional combustors and/or transition pieces having liners are generally capable of withstanding a maximum temperature on the order of only about 1500° F. for about 10,000 hours (hrs), steps to protect the combustor and/or transition piece must be taken. This is typically done by film-cooling, which involves introducing relatively cool compressor air into a plenum formed by the combustor liner surrounding the outside of the combustor. In this arrangement, the air from the plenum passes through louvers in the combustor liner and then passes as a film over the inner surface of the liner, thereby maintaining combustor liner integrity.

Figure 1:
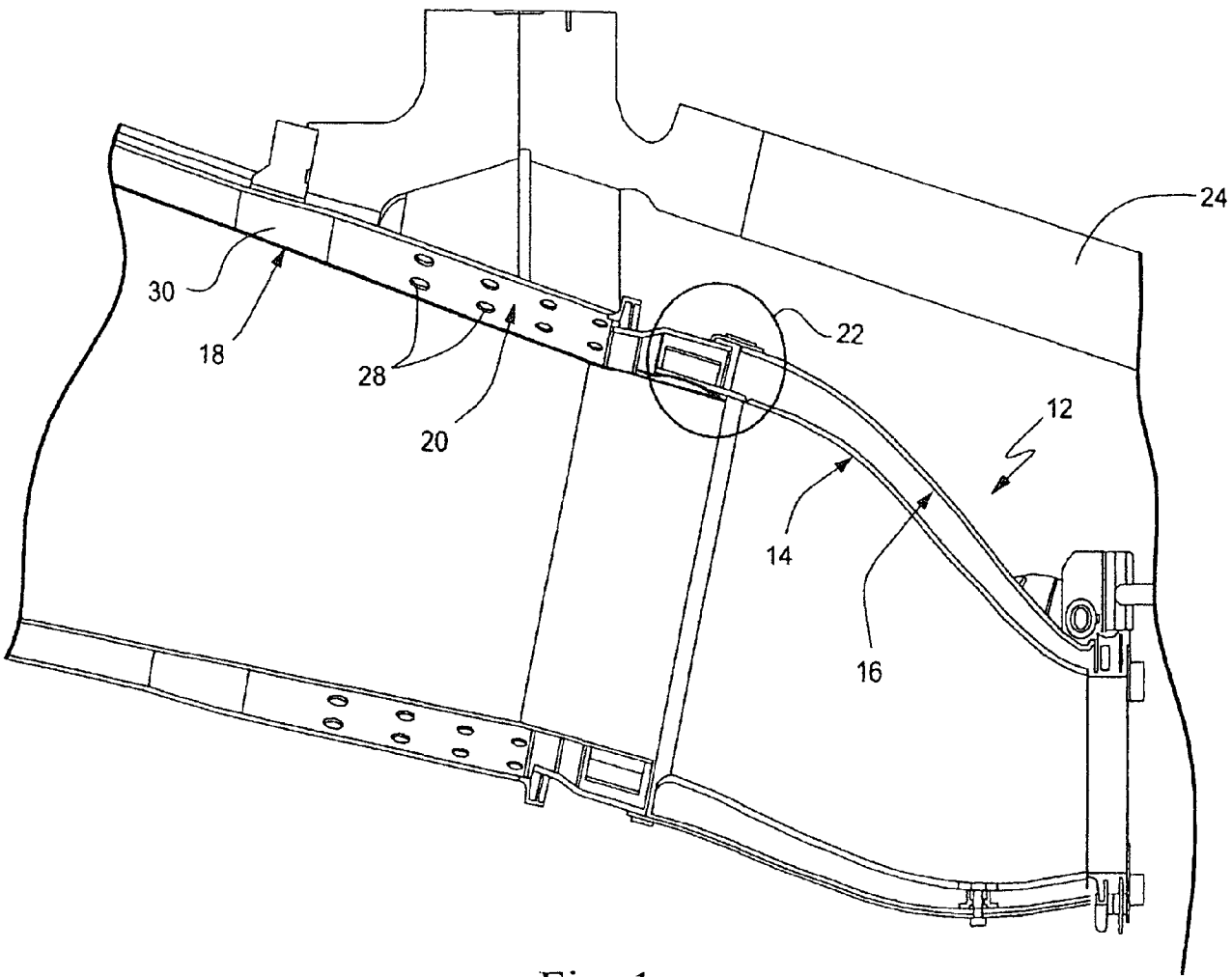
Fig. 1 PRIOR ART
FIG. 1 is a partial schematic illustration of a gas turbine combustor section.
Figure 2:
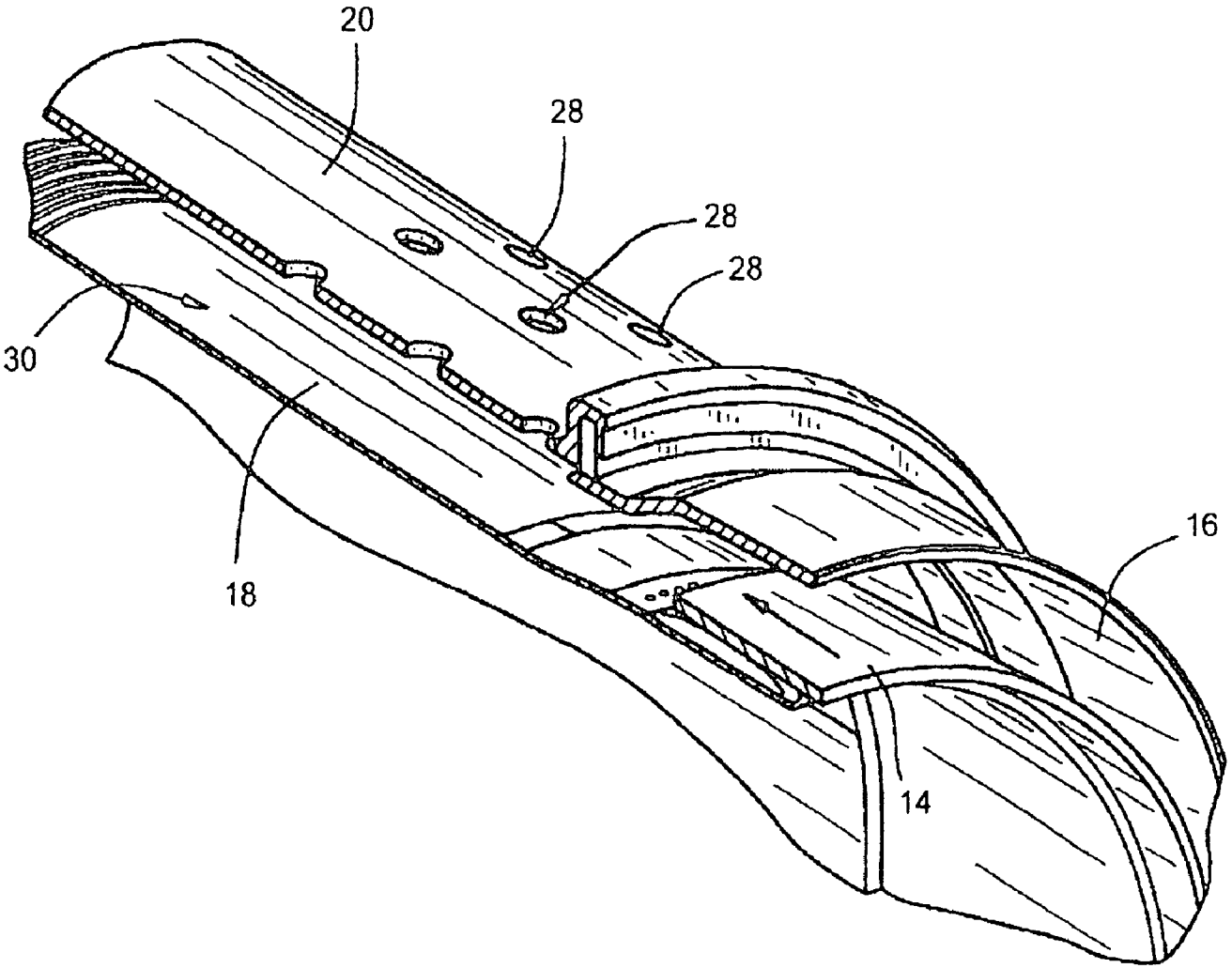
Fig. 2 PRIOR ART
FIG. 2 is a partial but more detailed perspective of a more conventional combustor liner and flow sleeve joined to the transition piece.

FIG. 1 schematically depicts the aft end of a combustor in cross-section. As can be seen, in this example, the transition piece 12 includes a radially inner transition piece body 14 and a radially outer transition piece impingement sleeve 16 spaced from the transition piece body 14. Upstream thereof is the combustion liner 18, having ports for air flow into the combustion chamber, and a combustor flow sleeve 20, defined in surrounding relation thereto. The encircled region is the transition piece forward sleeve assembly 22.

Flow from the gas turbine compressor unit (not shown) enters into a case 24. At least a portion of the compressor discharge air passes into cooling apertures 28 of the upstream combustor flow sleeve 20 and into a first flow annulus 30 between the flow sleeve 20 and the liner 18. The air eventually mixes with the gas turbine fuel in the combustion chamber.

One way to reduce cost associated with the IGCC reference plant is to achieve a higher net plant output for combined process and power blocks. Therefore, use of gas turbine compressor air becomes a viable option to reduce main air compressor ("MAC") load required for the air separation unit ("ASU"). Furthermore, as noted above, the available nitrogen supply from the ASU can be used as a diluent for NOx abatement. In addition, air extraction provides a means for gas turbine control across the operating range. Since the 1$^{st}$ stage nozzle is typically choked, air extraction becomes an important design consideration for low BTU fuel with a heating value about an order of magnitude less than that of natural gas. However, to realize the above benefits, the gas turbine requires modifications that allow the required air extraction. The challenge is accommodating additional extraction ports within the constraints of the existing assembly, and without impacting combustor durability and performance. The present invention provides gas turbine air extraction capability off the combustor case for supply to an air separation unit with minimum aerodynamic and mechanical risks.

To achieve this, the present invention provides a flow annulus or manifold internal to the combustion casing, formed between the casing and flow sleeve outer diameter for the purpose of extracting air for the gasification process.

Figure 3:
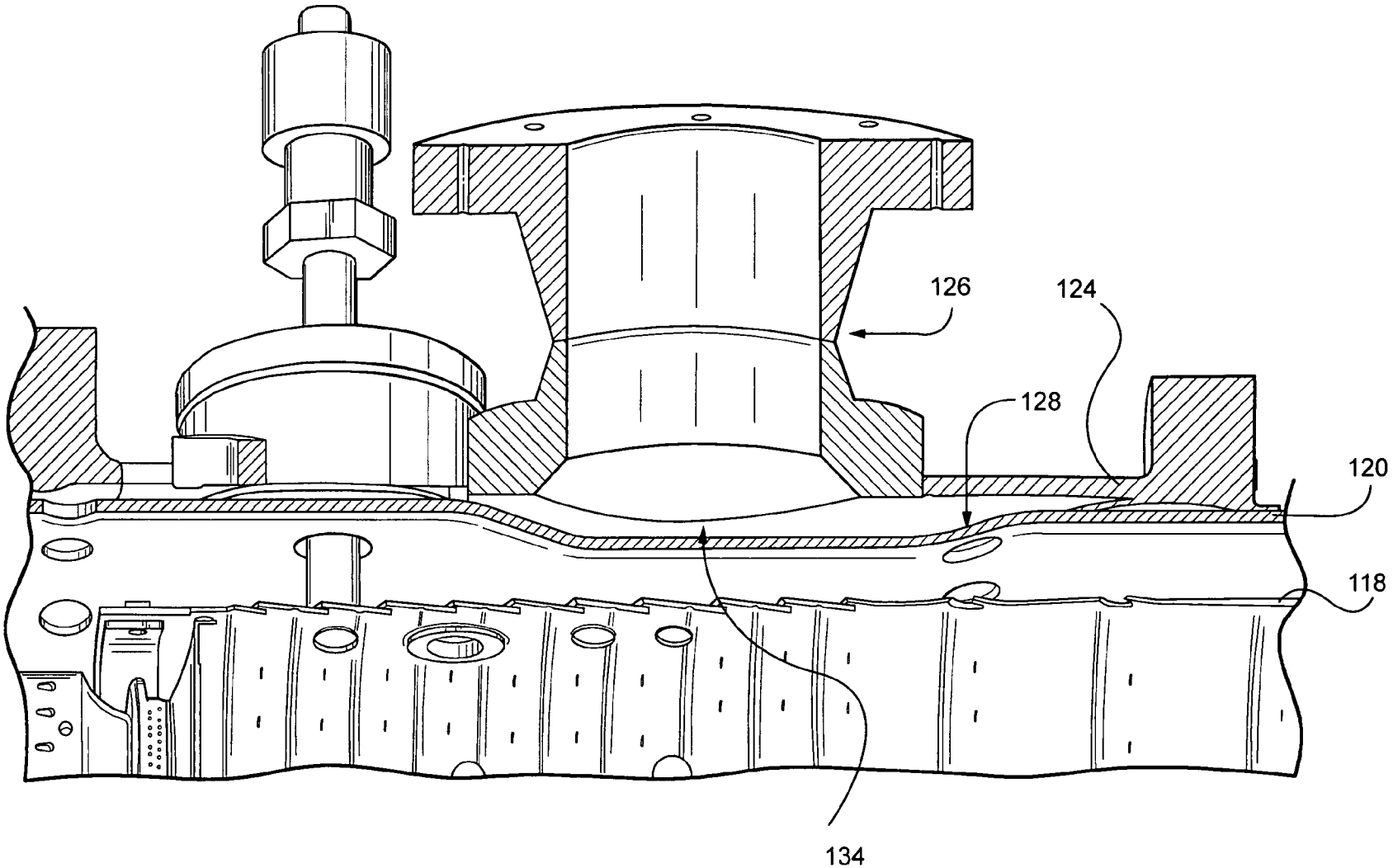
FIG. 3 is a schematic illustration, partly in cross-section and partly broken away, illustrating an internal manifold for air extraction as an example embodiment of the invention.
Figure 4:
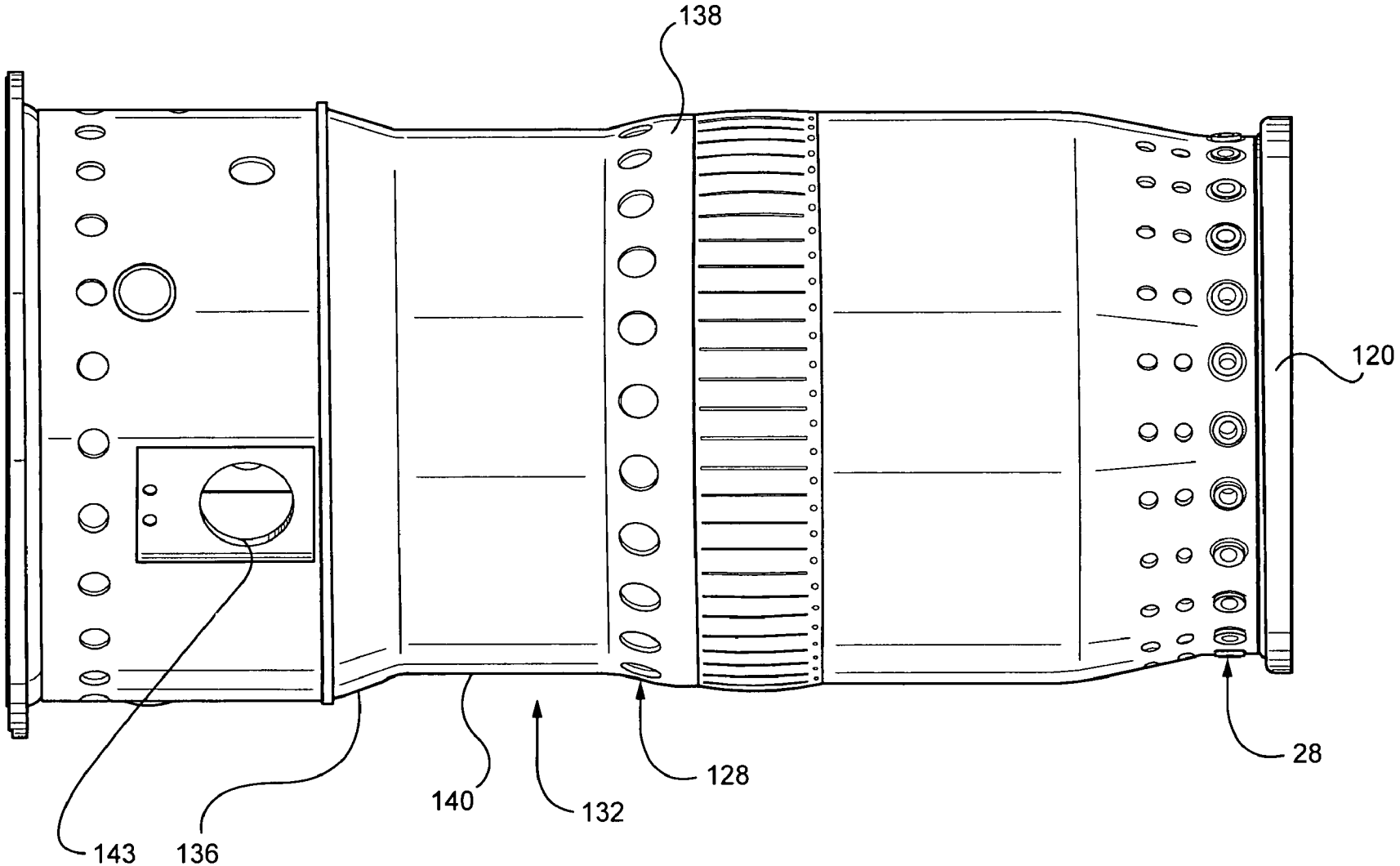
FIG. 4 is a schematic elevational view of a flow sleeve, according to an example embodiment of the invention.
Figure 5:
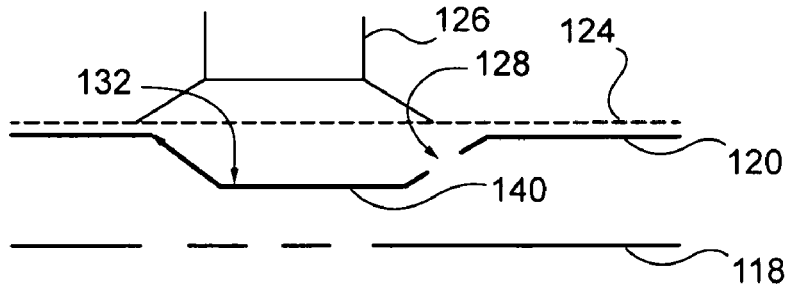
FIG. 5 is a schematic cross-sectional view of the combustor section shown in FIG. 3.

More specifically, referring to FIGS. 3-5, the invention employs a second flow annulus that wraps around the flow sleeve 120 in order to feed the air into a single extraction port 126, which port is mounted on the casing 124 at top-dead-center (TDC). This is accomplished by housing an internal manifold between the flow sleeve 120 and the casing 124. Furthermore, an air extraction opening or openings are located in the flow sleeve to allow uniform extraction around the liner. In the example embodiment illustrated in FIGS. 3-5, a plurality of air extraction holes 128 are provided. The holes are equally spaced, with 24 holes being provided in this example embodiment. According to the concept of the invention, these preferentially sized holes on the flow sleeve 120 are at the core of the extraction system design. As the Mach number between successive holes becomes increasingly higher from bottom to top, the extraction holes become progressively smaller.

By virtue of the symmetry of a cannular combustion system involving the liner, end cover, cap and fuel nozzle assembly, the combustor airflow is maintained uniform around the liner. As a result, the balance of air splits between louvered cooled liner 118, mixing jets, and six around zero nozzles is critical to combustor design. Therefore, introduction of a single point radial extraction off the combustor has to be carefully considered without causing any undesirable secondary flow field to the main combustor airflow between the liner and flow-sleeve. Otherwise, the loss of critical balance, previously mentioned, may adversely affect combustor dynamics, emissions, pressure drop, and component life. Furthermore, the air extraction system must meet the pressure drop allocation required by balance of plant (BOP). Also, extraction cavity pressure must be high enough to prevent backflow of hot gas through cross-fire tube port 143.

In the illustrated example embodiment, a circumferential recess or groove 132, is formed in the flow sleeve 120 to define a cavity or flow annulus 134 between the sleeve 120 and the casing 124. An extraction port 126 is coupled to the casing 124 for extracting air at one point about the periphery of the combustor. In the embodiment of FIGS. 3-5, the circumferential groove 132 includes a first inclined wall 136 at one axial end thereof, a second inclined wall 138 at the other axial end thereof, and a bottom wall 140. In this embodiment, the so-called at least one air extraction opening comprises a plurality of air extraction apertures 128 formed about a circumference of the first flow sleeve 120, through the downstream inclined wall 138.

FIGS. 6-10 illustrate alternate configurations of the flow sleeve and casing relative to the FIG. 1 embodiment.

Figure 6:
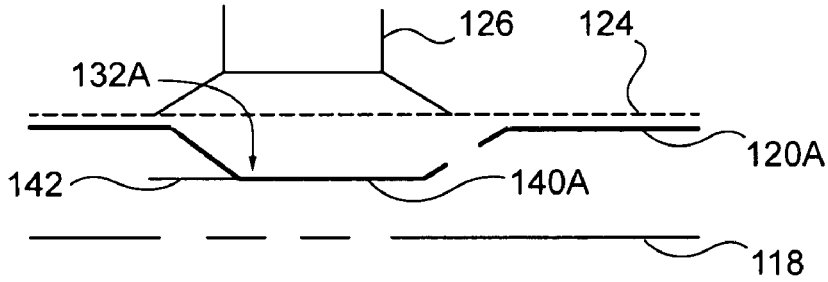
FIG. 6 is a schematic cross-sectional view similar to FIG. 5 illustrating an alternate flow sleeve configuration.

Specifically, FIG. 6 further illustrates a baffle extension 142 of the bottom wall 140A of the groove 132A of the flow sleeve 120A for overlying the most downstream inlet port (relative to the direction of cooling air flow through the first annulus) to the combustion chamber for a consistent plenum diameter overlying those inlet ports.

Figure 7:
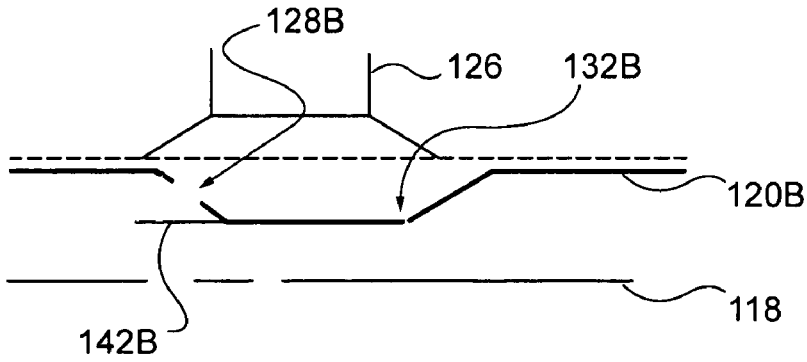
FIG. 7 is a cross-sectional view, similar to FIG. 6, showing a further alternate flow sleeve configuration.

FIG. 7 is similar to the FIG. 6 embodiment, but the plurality of uniformly spaced extraction openings or ports 128B about the periphery of the flow sleeve 120B are disposed on the downstream side of the circumferential recess or groove 132B and shielded from the inlets in the liner by the baffle extension 142B.

Figure 8:
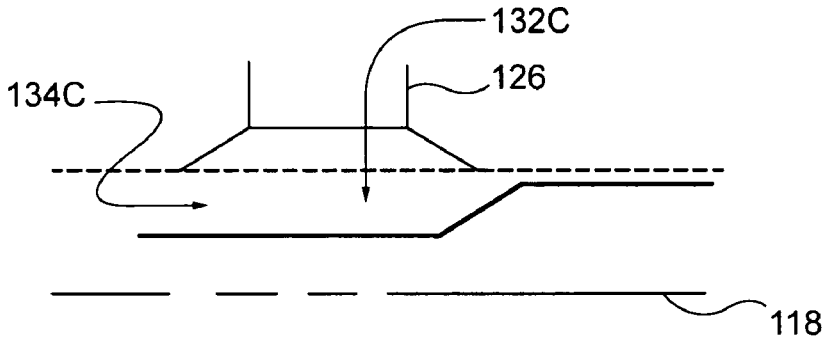
FIG. 8 is a cross-sectional view similar to FIG. 7, showing yet another flow sleeve configuration.

FIG. 8 is similar to the FIG. 7 embodiment, but omits the downstream wall of the groove 132C such that the second flow annulus 134C is open to the first flow annulus at the downstream end of the flow sleeve 120C to define a continuous passage for flow of cooling air from the first flow annulus to the second flow annulus and on to the extraction port.

Figure 9:
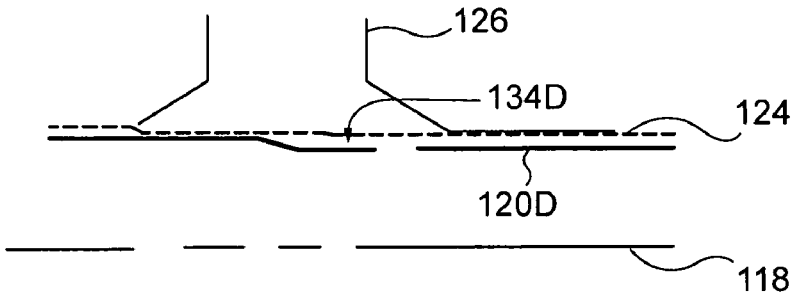
FIG. 9 is a schematic cross-sectional view showing a further alternate flow sleeve configuration.

FIG. 9 illustrates a shallow plenum 134D defined by offsetting the flow sleeve 120D from the casing 124 in the axial vicinity of the extraction port.

Figure 10:
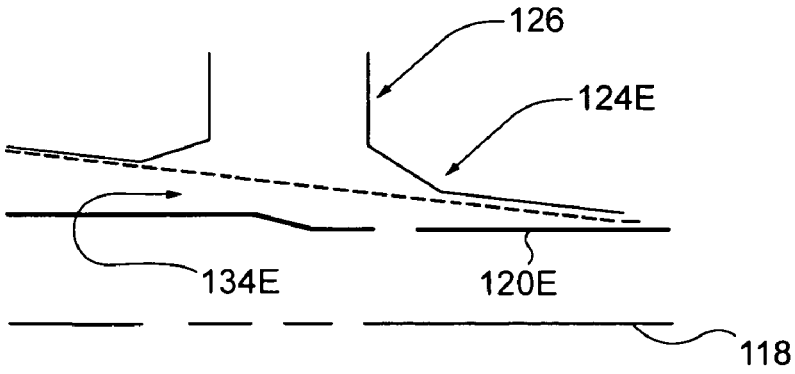
FIG. 10 is a schematic cross-sectional view similar to FIG. 9, showing an alternate casing configuration.

Finally, FIG. 10 illustrates a casing 124E that is inclined or flared with respect to the liner and flow sleeve 120E, so that a plenum or second flow annulus 134E is defined with the flow sleeve.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a turbine comprising:

a combustor liner;

a first flow sleeve encircling said combustor liner to define a first flow annulus therebetween, said first flow sleeve having at least one cooling aperture formed about a circumference thereof for directing compressor discharge air as cooling air into said first flow annulus;

a casing surrounding said first flow sleeve with a second flow annulus therebetween, said first flow sleeve having at least one air extraction opening formed about a circumference thereof for directing at least some of said compressor discharge air that has been directed into said first flow annulus as cooling air, from said first flow annulus directly into said second flow annulus as extraction air; and an extraction port operatively coupled to said casing for extracting said extraction air from said second flow annulus.

2. A combustor as in claim 1, wherein said extraction port is operatively coupled to an air separation unit so that air extracted from said second flow annulus is delivered to the air separation unit as inlet air therefor.

3. A combustor as in claim 1, wherein said first flow sleeve includes a circumferential groove to define said second flow annulus with said casing.

4. A combustor as in claim 3, wherein said circumferential groove includes a first inclined wall at one axial end thereof, a second inclined wall at the other axial end thereof, and a bottom wall, and said at least one air extraction opening comprises a plurality of air extraction apertures formed about a circumference of said first flow sleeve, through one of said inclined walls.

5. A combustor as in claim 4, wherein said bottom wall of said groove is substantially parallel to said combustor liner.

6. A combustor as in claim 5, wherein a baffle member extends from said bottom wall of said groove.

7. A combustor as in claim 6, wherein said baffle wall extends in an axial upstream direction with respect to a direction of combustion gases flow through said combustor liner.

8. A combustor as in claim 1, wherein said at least one air extraction opening comprises a plurality of air extraction apertures formed about a circumference of said first flow sleeve.

9. A combustor as in claim 8, wherein the air extraction apertures defined in said first flow sleeve are preferentially sized holes to provide circumferentially uniform extraction around the combustor liner.

10. A combustor as in claim 1, wherein said casing is inclined with respect to said combustor liner in a vicinity of said air extraction port to define said second flow annulus with said first flow sleeve.

11. A combustor as in claim 1, wherein said flow sleeve is stepped in a vicinity of said air extraction port to define said second flow annulus.

12. A combustor as in claim 11, wherein said stepped flow sleeve terminates at an upstream end thereof, with respect to a direction of combustion gas through said combustion liner, in spaced relation to said casing and to said combustor liner so that said second annulus is in open communication with said first annulus at said upstream end of said flow sleeve whereby compressor discharge air can flow from said first annulus to said second annulus and to said extraction port.

13. A turbine engine comprising:

combustion section;

an air discharge section downstream of the combustion section;

a transition region between the combustion and air discharge sections;

a combustor liner defining a portion of the combustion section and transition region;

a first flow sleeve encircling said combustor liner to define a first flow annulus therebetween, said first flow sleeve having at least one cooling aperture formed about a circumference thereof for directing compressor discharge air as cooling air into said first flow annulus;

a casing surrounding first flow sleeve with a second flow annulus therebetween, said first flow sleeve having at least one air extraction opening formed about a circumference thereof for directing at least some of said compressor discharge air that has been directed into said first flow annulus as cooling air, from said first flow annulus directly into said second flow annulus as extraction air; and an extraction port operatively coupled to said casing for extracting said extraction air from said second flow annulus.

14. A turbine engine as in claim 13, wherein said extraction port is operatively coupled to an air separation unit so that air extracted from said second flow annulus is delivered to the air separation unit as inlet air therefor.

15. A turbine engine as in claim 13, wherein said first flow sleeve includes a circumferential groove to define said second flow annulus with said casing.

16. A turbine engine as in claim 15, wherein said circumferential groove includes a first inclined wall at one axial end thereof, a second inclined wall at the other axial end thereof, and a bottom wall, and said at least one air extraction opening comprises a plurality of air extraction apertures formed about a circumference of said first flow sleeve, through one of said inclined walls.

17. A turbine engine as in claim 16, wherein a baffle member extends from said bottom wall of said groove in an axial upstream direction with respect to a direction of combustion gases flow through said combustor liner.

18. A turbine engine as in claim 13, wherein said at least one air extraction opening comprises a plurality of air extraction apertures formed about a circumference of said first flow sleeve.

19. A turbine engine as in claim 18, wherein the air extraction apertures defined in said first flow sleeve are preferentially sized holes to provide circumferentially uniform extraction around the combustor liner.

20. A method of extracting air from a combustion section comprising a combustor liner, a first flow sleeve encircling said combustor liner to define a first flow annulus therebetween, and a casing surrounding said first flow sleeve, said first flow sleeve having at least one cooling aperture formed about a circumference thereof for directing compressor discharge air as cooling air into said first flow annulus, the method comprising:

forming a second flow annulus between said casing and said first flow sleeve;

forming at least one air extraction opening about a circumference thereof for directing at least some of said compressor discharge air that has been directed into said first flow annulus as cooling air from said first flow annulus directly into said second flow annulus as extraction air;

operatively coupling an extraction port to said casing for extracting said extraction air from said second flow annulus;

supplying compressor discharge air through said at least one cooling aperture into said first flow annulus as cooling air;

flowing at least some of said cooling air directly from said first flow annulus through said at least one air extraction opening into said second flow annulus; and extracting air from said second flow annulus through said extraction port.

21. A combustor for a turbine comprising:

a combustor liner;

a first flow sleeve surrounding said combustor liner with a first flow annulus therebetween, said first flow sleeve having at least one cooling aperture formed about a circumference thereof for directing compressor discharge air as cooling air into said first flow annulus;

a casing surrounding said first flow sleeve with a second flow annulus therebetween, said first flow sleeve having at least one air extraction opening formed about a circumference thereof for directing compressor discharge air from said first flow annulus as extraction air into said second flow annulus; and an extraction port operatively coupled to said casing for extracting said extraction air from said second flow annulus, wherein said first flow sleeve includes a circumferential groove to define said second flow annulus with said casing.

* * * * *